United States Patent [19]

Kliewer

[11] Patent Number: 5,004,016

[45] Date of Patent: Apr. 2, 1991

[54] PIPE THREAD PROTECTOR DEVICE

[76] Inventor: Justin J. Kliewer, 404 S. First, Fairview, Okla. 73737

[21] Appl. No.: 463,256

[22] Filed: Jan. 10, 1990

[51] Int. Cl.[5] ..... B65D 59/06

[52] U.S. Cl. ..... 138/96 T; 138/96 R; 138/89; 138/110

[58] Field of Search ..... 138/89, 96 R, 96 T, 138/109, 178, 110

[56] References Cited

U.S. PATENT DOCUMENTS

| | | | |
|---|---|---|---|
| 2,189,987 | 2/1940 | Kellems | 138/118 |
| 2,215,829 | 9/1940 | Evans | 138/96 R |
| 4,398,566 | 8/1983 | Janzen | 138/96 T |
| 4,415,005 | 11/1983 | Janzen | 138/96 T |
| 4,425,945 | 1/1984 | McDonald | 138/96 T |
| 4,531,719 | 7/1985 | Hoppie et al. | 138/109 |

*Primary Examiner*—James E. Bryant, III

*Attorney, Agent, or Firm*—Laney, Dougherty, Hessin & Beavers

[57] ABSTRACT

A pipe thread protector device for protecting the threads at the end of a casing section or the like, and including an elastomeric shoe having a cavity or recess in one side thereof for receiving the threaded end of the casing, and further having an elongated generally cylindrical constriction sleeve made of braided or interwoven wire elements connected to the shoe. One end of the constriction sleeve is embedded in this shoe and the other carries a plurality of tensioning tongues. The constriction sleeve construction causes it to undergo a reduction in diameter when it is placed in tension, and an enlargement in diameter when placed in compression. A hook is secured to the center of the elastomeric shoe and projects therefrom to permit the entire thread protector device to be removed from a casing section upon which it is used to protect the thread, and then slid down a wire extending from the location upwardly in a derrick to which the pipe has been lifted to, to a location on the rig floor where it can be utilized on another section of casing.

2 Claims, 1 Drawing Sheet

PIPE THREAD PROTECTOR DEVICE

FIELD OF THE INVENTION

This invention relates to thread protectors, and more particularly, to large, generally elastomeric thread protectors of the type employed to surround and protect the external threads formed at the end of a section of casing, or similar tubular stock.

BACKGROUND OF THE INVENTION

Brief Description Of The Prior Art

Many types of thread protector devices have previously been constructed and utilized for the purpose of preventing damage to external threads carried at the end of a section of casing, as that casing section is hoisted in a well derrick preparatory to coupling the casing to a section being extended into the well. Generally these thread protectors have been cup-shaped in overall general configuration, so that the threaded end of the casing section can be extended into a cavity or recess in the cup. The remainder of the cup will then surround the threads and prevent them from being struck by metallic structures on the derrick or by other sections of casing.

Two types of such elastomeric thread protectors which have previously been patented are those which are shown in Janzen U.S. Pat. No. 4,398,566 and Janzen U.S. Pat. No. 4,415,005.

BRIEF DESCRIPTION OF THE PRESENT INVENTION

The present invention provides a pipe thread protector device which is very easy to use, and is retained tenaciously on a pipe section in a position to protect the threads thereof as the pipe section is moved about for the purpose of making up a string of casing, tubing or the like in a well bore.

Broadly described, the pipe thread protector device of the invention includes an elastomeric shoe which is generally of frustoconical configuration and has a cavity or recess extending into one end of the shoe for the purpose receiving a threaded pipe end into the shoe and protecting the threads thereon. An elongated generally cylindrical constrictor sleeve is connected to the shoe, and is positioned for extension coaxially along and around the pipe carrying the threads to be protected. One end of the constriction sleeve is connected to the shoe, and is preferably bonded into the elastomeric material of which the shoe is constructed. At its other end, the constriction sleeve carries a plurality of tensioning tabs or tongues which enable a tensile force to be applied to the constriction sleeve. The constriction sleeve is made of a plurality of interwoven wire elements. The interweaving of these elements is such that when the tension sleeve is placed in tension, it undergoes a reduction in diameter, and when placed in compression, its diameter is enlarged. This enables it to be very easily put onto the pipe having the threads to be protected, and then secured firmly thereon, but removed quite easily by simply applying a force tending to compress the tension sleeve so that it is released from constrictive engagement with the pipe.

An important object of the present invention is to provide an improved pipe thread protector device which can be quickly and easily placed over the end portion of a threaded pipe so as to protect the external threads carried at one end thereof by surrounding these threads with a part of the pipe thread protector.

A further object of the invention is to provide a pipe thread protector device which is characterized in having a long and trouble free operating life, and which can be used by a person, without special skills or training for the purpose of protecting the threads at the end of a section of well casing or the like.

Additional objects and advantages of the invention will become apparent as the following detailed description of a preferred embodiment of the invention is read in conjunction with the accompanying drawings which illustrate such preferred embodiment.

GENERAL DESCRIPTION OF THE DRAWINGS

DETAILED DESCRIPTION OF A PREFERRED EMBODIMENT OF THE INVENTION

Figure 1:
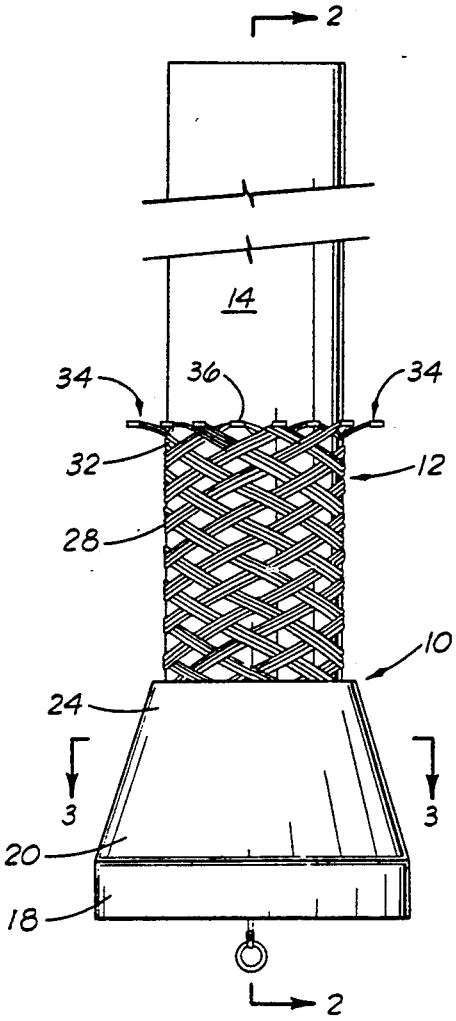
FIG. 1 is a side elevation view of the pipe thread protector device of the invention as it appears when it has been placed on the end of a section of well casing in order to protect external threads carried thereon.

The pipe thread protector device of the invention includes a resilient protector shoe subassembly designated generally by reference numeral 10. The pipe thread protector device further includes an elongated, woven wire cylindrical constriction sleeve 12 which has one end connected to the resilient protector shoe in a manner hereinafter described. In FIG. 1 of the drawings, the pipe thread protector is shown operatively mounted on one end of an elongated section of casing 14. The casing section 14 carries external threads 16 of a conventional character.

The resilient protector shoe 10 can be suitably constructed of rubber or elastomeric material, such as a synthetic resin, so as to be able to absorb shocks and bumps in functioning to protect the threads 16. The shoe 10 includes a short cylindrical section 18 at its lower or outer end, or stated differently, at its side opposite the side which surrounds and is immediately adjacent the threads 16. The shoe 10 further includes a central frustoconical body 20 of the elastomer of which it is constructed. The shorter and inner of the two sides of the central frustoconical body 20 is denominated by reference numeral 22, and this surface bears against the thread-carrying end of the casing 14.

A hollow or recessed frustoconical upper or terminal part of the shoe is denominated by reference numeral 24. The hollow upper part 24 of the shoe 10 lies on the opposite side of the central frustoconical body 20 from the short cylindrical section 18. It extends around the outer side of the casing, and by reason of its frustoconical configuration, it is spaced outwardly from the threads 16. It converges on the outer side of the casing section 14, however, and when it is mounted in its operative position, its upper end 26 contacts the casing completely around its outer periphery at a location spaced along the casing section from the threads.

The woven wire cylindrical constriction sleeve 12 is made up of a plurality of heavy, elongated wire elements 28 interwoven in the manner illustrated in FIG. 1. The inner woven wire elements 28 form a tube or cylinder, and interact with each other so that when a tensile force tending to elongate the cylinder is applied to its opposite ends, or to one end while the other is held stationary, the diameter of the cylinder is reduced. Stated differently, the sleeve 12 undergoes constriction at that time. Conversely, if a compressive force is applied to opposite ends of the constriction sleeve, its diameter tends to enlarge.

Figure 2:
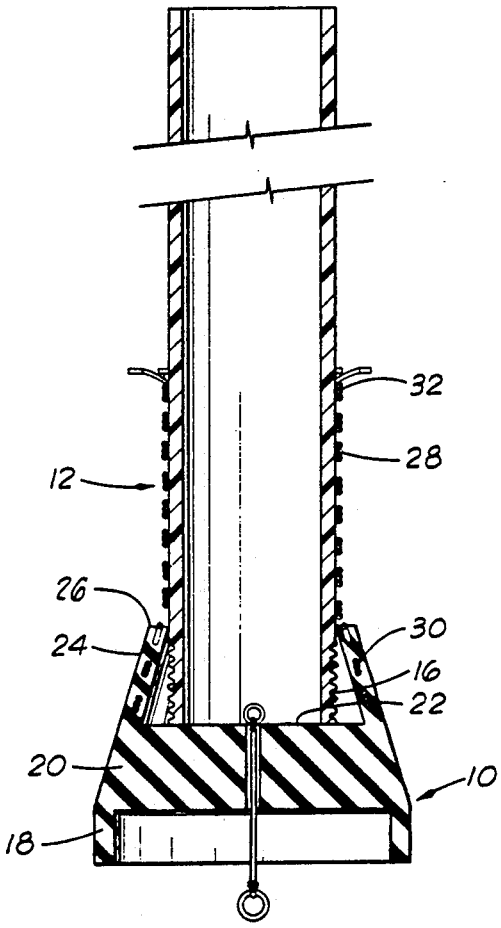
FIG. 2 is a sectional view taken along line 2—2 of FIG. 1.
Figure 3:
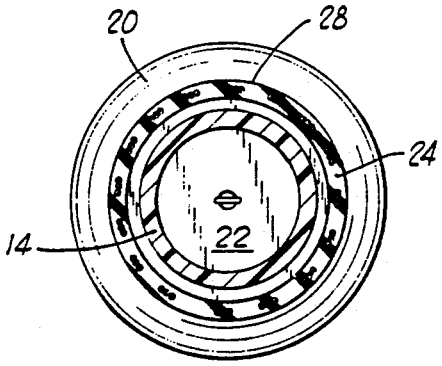
FIG. 3 is a sectional view taken along line 3—3 of FIG. 1.
Figure 4:
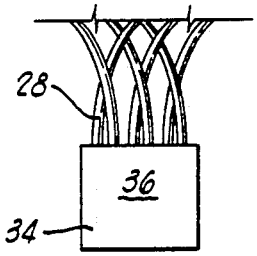
FIG. 4 is a schematic or diagrammatic view of the upper end of the pipe thread protector device showing the construction of one of the tensioning tongues forming one of many such tongues located at the upper end of a woven wire cylindrical constriction sleeve forming a part of the pipe thread protector device of the invention.

As best illustrated in FIG. 2 of the drawings, one end 30 of the cylindrical constriction sleeve is secured to the shoe 10 by embedding a part of the wire elements 28 in the elastomeric material making up the hollow frustoconical upper part of the shoe. This not only functions to anchor one end of the constriction sleeve 12, but this construction gives a desired degree of rigidity and structural strength to that part of the shoe which is spaced radially outwardly from the threads 16. At its upper end 32 (the end spaced along the casing section 14 from the thread 16), the constriction sleeve 12 carries a plurality of circumferentially arrayed tensioning tongues 34. As shown in FIG. 4, each of these tensioning tongues is formed by engaging outwardly flared end portions of several of the heavy wire elements 28 with metal clips 36 so as to form an outwardly protruding loop.

In the utilization of the pipe thread protector device of the invention, casing sections which are to be handled, and which require protection of the threads carried at one end thereof are positioned so that the end of the casing section carrying the threads is exposed, thus facilitating the mounting of the thread protector device thereon. At this time, the circumferentially arrayed tensioning tongues 34 are pushed in the direction of the shoe 10 while the base portion 18 is abutted against some stop so that it cannot move as the constriction sleeve is compressed. Pushing on the circumferentially arrayed tensioning tongues 34 will shorten the constriction sleeve and thereby enlarge its diameter slightly. At this time, the constriction sleeve 12 can be easily passed over the end of the casing section 14 until it extends along the casing section a sufficient distance that the end of the casing section will abut against the surface 22 forming one side of the frustoconical central section 20 of the shoe 10. After this has been accomplished, the tensioning tongues 34 are pulled in a direction away from the shoe 10, thereby constricting and reducing the diameter of the constriction sleeve 12. This causes the constriction sleeve to very tightly engage the outer surface of the casing section 14 around the entire outer periphery of the casing section. Any effort to pull the shoe 10 off of the casing section so that it does not protect the threads 16 will fail because a force tending to pull the shoe away from the casing section will only apply a tensile force to the constriction sleeve 12 causing it to constrict and more tightly engage the casing section.

The lower end of the constriction sleeve 12 functions to reenforce the hollow, frustoconical upper end portion 24 of the shoe 10. In doing so, it prevents a substantial force impacted on the outer side of the shoe at this location from driving the upper portion of the shoe inwardly against the threads 16 with sufficient force to damage the threads.

In order to permit the thread protector device to be moved back to the rig floor from a location in the derrick after the protector device has been released from the end of a section of casing, the threads of which have been protected, a retrieval shaft and eye subassembly 50 is provided. By means of this, the thread protector can be attached to a hook and slid down a trolley or a slide wire extending from the top of the derrick to the rig floor and there used on the next section of casing after detachment from the slide wire.

Although a preferred embodiment of the invention has been herein described in order to explain the way the pipe thread protector device of the invention is constructed, and the principles which make it highly effective as a thread protector, various changes and innovations can be effected in the illustrated and described structure without departure from the basic principles which underlie the invention. All such changes and innovations which continue to rely on such basic principles are therefore deemed to be circumscribed by the spirit and scope of the invention except as the same may be necessarily limited by the appended claims, or reasonable equivalents thereof.

What is claimed is:

1. A pipe thread protector device comprising:

a shoe constructed for fitting around, and abutting against, the threaded end of an elongated section of pipe having a thread on one end thereof, said shoe being constructed of an elastomeric material and including a frustoconical portion positioned for surrounding the threads on the pipe when the pipe end abuts an internal surface in the shoe; and an elongated tubular woven wire mesh constriction sleeve having one of its ends connected to said shoe and positioned relative to said shoe for extending coaxially around a threaded pipe when the frustoconical portion of said shoe extends around the threads of said pipe, said woven wire mesh constriction sleeve being constructed so that said sleeve undergoes a reduction in diameter when a tensile force is applied to the sleeve tending to elongate the sleeve, and undergoing an increase in diameter when a compressive force is applied to opposite ends of the sleeve.

2. A pipe thread protector device comprising:

an elastomeric shoe configured for fitting around, and abutting against, the threaded end of an elongated section of pipe having a thread on one end thereof, said shoe including:

a central body of the elastomer extending transversely across the shoe for abutting the thread carrying end of the pipe when the thread protector device is in place on the pipe; and a frustoconical terminal part of the shoe adjacent the central body; and an elongated tubular sleeve comprising flexible elements woven together in a mesh configuration, with said sleeve having one of its ends connected to said shoe and positioned relative to said shoe for extending coaxially around a threaded pipe when the frustoconical portion of said shoe extends around the threads of said pipe, said sleeve being constructed so that said sleeve undergoes a reduction in diameter when a tensile force is applied to the sleeve tending to elongate the sleeve, and undergoing an increase in diameter when a compressive force is applied to opposite ends of the sleeve, whereby the sleeve can selectively be made to grip the pipe or release the pipe.

* * * * *